United States Patent [19]

Ito et al.

[11] 3,945,726

[45] Mar. 23, 1976

[54] ELECTROPHOTOGRAPHIC FIXING DEVICE

[75] Inventors: Yoshio Ito, Yokohama; Toru Takahashi, Tokyo; Takayuki Ishihara, Tokyo; Hiroo Kobayashi, Tokyo; Atsushi Matsuoka, Kawasaki, all of Japan

[73] Assignee: Canon Kabushiki Kaisha, Tokyo, Japan

[22] Filed: Sept. 16, 1974

[21] Appl. No.: 506,087

[30] Foreign Application Priority Data

Sept. 17, 1973 Japan ..... 48-104743

[52] U.S. Cl. ..... 355/3 R; 219/216; 427/22; 432/8

[51] Int. Cl.[2] ..... G03G 15/20

[58] Field of Search ..... 355/3 R, 3 FU; 219/216, 219/388; 427/22; 117/21

[56] References Cited

UNITED STATES PATENTS

| | | | |
|---|---|---|---|
| 3,256,002 | 6/1966 | Hudson | 96/1.4 UX |
| 3,682,738 | 8/1972 | Smith | 117/21 X |
| 3,811,821 | 5/1974 | Ariyama et al. | 432/8 |

*Primary Examiner*—Robert P. Greiner
*Attorney, Agent, or Firm*—Fitzpatrick, Cella, Harper & Scinto

[57] ABSTRACT

An electrophotographic fixing device which is fundamentally constructed by assembling a heat fusing roller made of a resilient material, a rigid press-contacting roller, and a heating roller, wherein the heat fusing roller is provided at a position to contact a copying material at the side thereof bearing a developed image, and has its surface heated by means of the heating roller, and wherein the copying material is pressed against the heat fusing roller by the press-contacting roller to complete the image fixing. The fixing device further includes means to apply an appropriate quantity of an image separating agent onto a front end part of a non-fixed reproduced image on the copying material, over a certain width, the device being provided at a position immediately preceding the fixing device and actuated by a timer.

14 Claims, 30 Drawing Figures

ELECTROPHOTOGRAPHIC FIXING DEVICE

BACKGROUND OF THE INVENTION

1. Field of the Invention

This invention relates to an electrophotographic fixing device for an electrophotographic reproduction apparatus, wherein a heat fusible developed image formed on a reproduction material is thermally fixed. In more detail, the present invention is particularly concerned with an improved electrophotographic fixing device of a heat roller type, wherein various advantages are perfectly realized, such as reduction in length of the preheating time, simplification in maintenence, miniaturization in the fixing device, stabilization in image-fixing and forwarding of the reproduction material, and prevention of the reproduction material from wrapping around the roller.

2. Description of the Prior Art

There has heretofore been known a heat roller type fixing device of this sort, wherein one of a pair of the rollers, which contacts the side of the reproduction material bearing the developed image, is made in the form of a heat-conductive tube, in which a source of heat is provided, and the other roller is constructed in the form of a resilient roller. According to this construction of the fixing device, the heat conductivity of the roller which is at the side of the developed image is satisfactory, and its thermal fixation is found to be superior. On the other hand, however, since the surface of the developed image is press-contacted by the resilient roller against the surface of the tubular roller having a hard surface, the reproduction material is liable to deform by curving along the peripheral surface of the hard tubular roller with the consequence that the reproduction material tends to cause wrapping around the hard tubular roller along with adhesivity of the molten developing agent. This tendency has been considerably accelerated as the fusibility of the toner becomes better and better. In order, therefore, to prevent the reproduction material from sticking around the roller surface, it has become essential that, on the surface of the roller which contacts the developed image side of the reproduction material, an offset prevention liquid for the developed image be applied to prevent the reproduction material from sticking around the roller. However, since most of this offset prevention liquid is usually fatty in nature, and is therefore liable to contaminate the reproduction material upon its adhesion thereto, there have been brought about grave obstructions such as unsmooth hand-touch on the surface of the reproduction material after completion of the reproduction operation, incompatability of the surface of the reproduction material with ink, when manuscript in ink becomes necessary thereon, contamination of air due to evaporation of the offset prevention liquid, and so on.

On the other hand, it has been contemplated that a resilient roller be used as the roller to contact the developed image side of the reproduction material so as to avoid wrapping of the reproduction material around the roller, from which a favorable result has been obtained. In this case, however, as the heat source is placed within the resilient tubular body which is usually inferior in its heat conductivity, a considerably long time is taken to obtain the surface temperature of the roller required for the thermal fusion of the toner, which has been the cause for the long waiting time until the reproduction operation starts, hence this does not satisfy the practical requirements.

SUMMARY OF THE INVENTION

With the afore-metioned existing problems as to the electrophotographic fixing device in mind, it is the primary object of the present invention to provide a highly ideal electrophotographic fixing device which has perfectly solved the defects in the conventional device as mentioned in the foregoing.

It is another object of the present invention to provide an electrophotographic fixing device which possesses good thermal fusing efficiency and a shortened waiting time for the commencement of the reproduction operations.

Another object of the present invention is to provide an electrophotographic fixing device which does not cause any offsetting of the developed image on the rollers and to provide a highly ideal electrophotographic fixing device, wherein the reproduction material does not wrap around the roller surface.

A further object of the present invention is to provide an improved electrophotographic fixing device, in which no undesirable effect due to vapor of the offset prevention liquid would take place.

The foregoing object and other objects as well as the construction, function, and resulting effects of the proposed fixing device according to the present invention will become more apparent from the following detailed description when read in conjunction with the accompanying drawing.

DESCRIPTION OF THE PREFERRED EMBODIMENTS

The electrophotographic fixing device according to the present invention can be realized by providing a resilient roller as the heat fusing roller which contacts the side of the reproduction or copying material on which a developed image is held, and by heating this resilient roller surface from outside, and causing the copying material which holds the developed image to pass between the heat fusing roller and a press-contacting roller, thereby completing the image fixing. Then an appropriate quantity of an image removing agent is applied to the surface of an unfixed reproduction image with a certain definite width at the front end part in the forwarding direction thereof through a device which is provided at a position immediately preceding the fixing device along with a timer device to detect arrival of the unfixed reproduction image, thereby attaining the purpose of the invention.

Detailed explanations of the electrophotographic fixing device in accordance with the present invention will follow in reference to the accompanying drawings.

Figure 1:
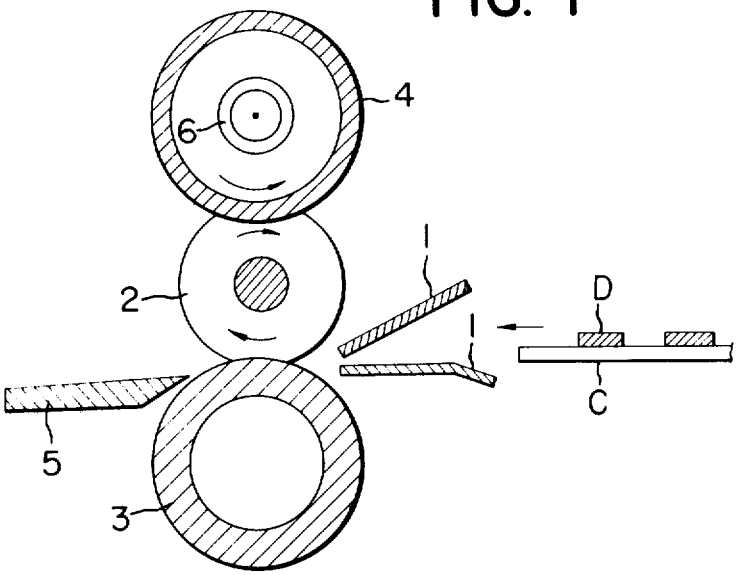
FIG. 1 is a side elevational view illustrating the construction of the electrophotographic fixing device according to the present invention.

Referring first to FIG. 1, which indicates one embodiment of the fixing device according to the present invention, a reproduction or copying material C holding thereon a developed image D is fed through a guide plate 1 into a position between a heat fusing roller 2 and a roller 3 press-contacting thereto. The heat fusing roller 2 has been preliminarily heated by a heating roller 4 so as to promptly fix the developed image held on the copying material by means of the heat fusion. The copying material C, onto which the developed image D has been fixed, is then forwarded by passing between the heat fusing roller 2 and the press-contacting roller 3, and is finally discharged outside along the guide plate 5. Accordingly, there tends to occur curving of the reproduction material which has been pressed by the resilient heat fusing roller toward the rigid press-contacting roller 3, and the reproduction material is prone to wrap around this resilient roller. However, as the fused image on the copying material draws the copying material toward the resilient roller, the force therebetween becomes extreme to prevent the copying material from wrapping around both rollers.

The details of the operation at every part of the device will be explained hereinbelow.

Figure 2:
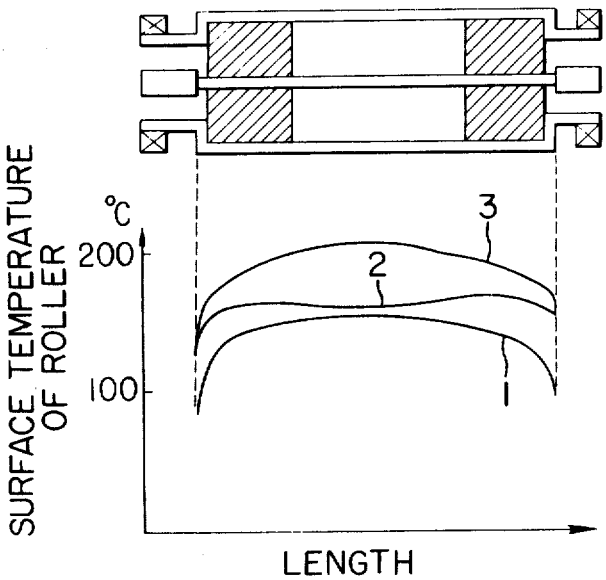
FIG. 2 is a graphical representation showing temperature distribution of the surface temperature of the heating rollers.

The heating roller 4 is in a hollow tubular shape and made of a material having good heat conductivity such as brass, aluminum, and so forth, within which a source of heat 6 such as an infrared ray lamp, etc. is accommodated. The inner wall of the hollow tubular roller is preferably coated with black paint, black plating, and so forth. The heating roller also tends to lower its temperature in the vicinity of both its ends in the axial direction thereof, because heat usually escapes outside through the bearing portion of the roller. In order to rectify this tendency, it is advisable that the exothermic density is so adjusted as to increase the density at both ends of the hollow tubular roller in its axial direction by various means such as application of the black paint, etc. on the inner wall surface of the above-mentioned hollow tubular roller only at its both ends in its axial direction, or provision of an infrared ray heater, and so on. FIG. 2 indicates the experimental data of the state of distribution of the surface temperature on the heating roller, in which the encircled numeral 1 indicates a case, wherein no coating is applied on the inner surface of the aluminum hollow tubular roller; the encircled numeral 2 indicates a case, wherein a black paint is applied at both end parts of the inner wall surface of the hollow tubular roller in the axial direction thereof; and the encircled numeral 3 indicates a case, wherein the entire inner wall surface of the hollow tubular roller is coated with the black paint. The heat fusing roller should preferably consist of a refractory resilient substance such as silicone rubber, etc. having a hardness of approximately 18° to 30°. For the press-contacted roller, a rigid material may be used.

Since a heat fusing roller of an elastic material is made to contact with the side of the copying material where the developed image is held, the separation of the copying material from the surface of the heat fusing roller has become satisfactory. Further, as has already been mentioned in the foregoing, since the resilient roller is low in its heat conductivity, when it is heated from its interior, the rising of the surface temperature thereof is slow and the temperature in the inner surface of the resilient material increases with the result that the resilient substance becomes liable to deteriorate by heat, or exfoliate due to destruction in adhesivity. In contrast to this, when the heating roller is separately provided to heat such heat fusing roller from outside as in the present invention, the image fixing can be achieved by heating only the surface layer of the heat fusing roller, and the temperature in the center part of the roller may be made lower than that at the surface thereof with the consequent reduction in the thermal deterioration of the resilient body or substance, hence a higher surface temperature can be applied to the roller surface. In such case of the external heating method, it is better to use rubber or like heatinsulating material having a low heat conductivity and a high adiabatic effect to constitute the heat fusing roller than to use metallic material of high heat conductivity, because, with such material of low heat conductivity, there is no inward dispersion of heat and the initial temperature rising characteristic is satisfactory.

As to the press-contacting roller, it is preferable that the surface of such press-contacting roller 3 constituted with a rigid material be provided thereon with an exfoliative coating of high heat resistance such as Teflon (a trademark for tetrafluoroethylene of E. I. du Pont de Nemour & Co.), and so forth in a thickness of 30 microns. The surface temperature of such press-contacting rigid roller should normally be lower than that of the resilient heat fusing roller by 10° to 30°C. The coating of the surface with such high heat resistant, exfoliative substance is to prevent the copying material from wrapping around the press-contacting roller in the case of forming powder images on both surfaces of the copying material. For this purpose, it is preferable that the temperature of the press-contacting roller be maintained by the heat transmitted from the heat fusing roller alone.

Figure 3:
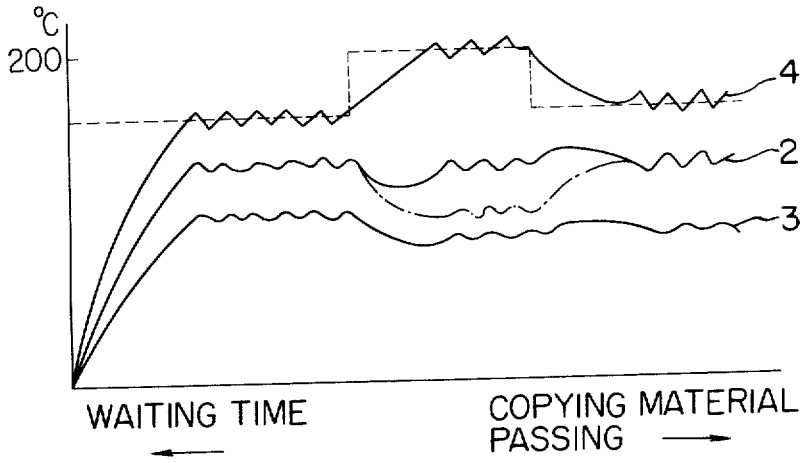
FIG. 3 is another graphical representation showing temperature variations on the surface of each roller for the fixing device according to the present invention.

Explaining now the temperature conditions of each roller which has been detailed hereinabove, since the resilient heat fusing roller is adiabatic in comparison with the metallic press-contacting roller, the rise in its surface temperature is quick, and the lowering of its surface temperature due to contact with the object such as recording paper, etc. supported thereon is also rapid, hence it is desirable to construct the roller in such a way that the diameter of the press-contacting roller be made smaller than that of the heating roller so as to increase its frequency to contact with the heating roller, or the set temperature of the heating roller be changed over to be made higher only at the time of passage therethrough of the reproduction material. FIG. 3 represents experimental data in relation to variations in the surface temperature of each roller in connection with the set temperature of the heating roller. In this graphical representation, the encircled numeral 4 denotes the surface temperature of the heating roller, the encircled numeral 2 designates the surface temperature of the heat fusing roller, and the encircled numeral 3 indicates the surface temperature of the press-contacted roller. In the drawing, the dash line (-----) particularly denotes the set temperature of a temperature control device which is slidable along the heating roller and indicates a case, wherein the set temperature is changed over at the time of passage of the reproduction material. In this case, if the set temperature is not changed over, the temperature of the elastic heat fusing roller becomes lower as shown by the dot-and-dash line (- · -). However, by this change-over of the set temperature, the temperature of the heating roller increases to augment the feeding amount of heat to the roller, hence the temperature of the heat fusing roller can be maintained substantially constant.

Application of pressure onto each of the rollers may be done by any means such as interposing the rubber roller between the outer heating roller and the inner press-contacting roller with a spring-spanning construction being applied on both rollers. However, pressure can also be applied to this resilient roller without use of the spring structure by leaving a fixed gap between the outer heating roller and the inner press-contacted roller which is made smaller than the outer diameter of the heat fusing resilient roller, and pushing the heat fusing resilient roller between them. In this case, there accrues such advantage that the resilient roller maintains a constant amount of deformation irrespective of fluctuation in hardness of the resilient roller, hence the contact time of the rubber for the image fixing can be advantageously maintained constant. In particular, when the three rollers are in one and the same plane, the durability of the resilient roller becomes advantageously higher without causing any abnormal deforming force on the resilient roller per se.

In the following, explanations will be made in reference to FIGS. 4A through 4F inclusive as to the mechanism for shifting the heat fusing resilient roller, depending on necessity, between the heating roller and the press-contacting roller which have been provided at their respective fixed positions.

Figures 4A, 4B, 4C:
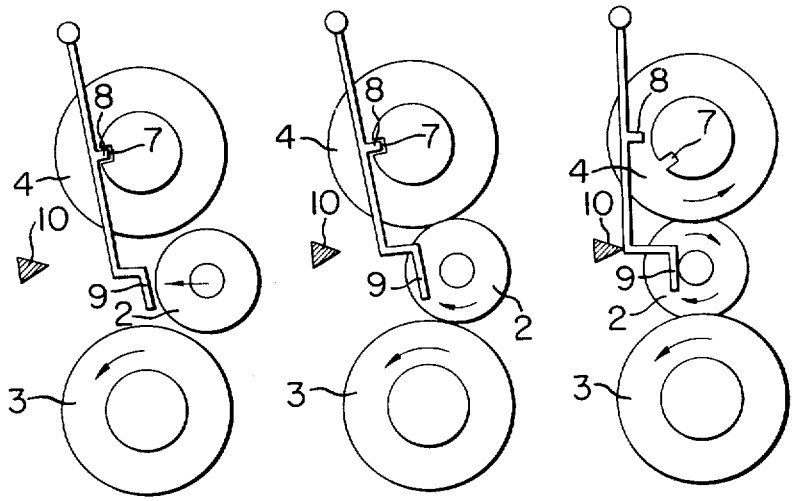
FIGS. 4A through 4F inclusive are respectively operational diagrams of the device according to the present invention.

In FIG. 4A, the heat-fusing resilient roller 2 which is at a non-contact position with the rigid heating roller 4 and the press-contacting roller 3, both having their own fixed shaft or axle, and which has its own shiftable axle is caused to move in the horizontal direction between the rollers 3 and 4 with the driving of the press-contacting roller 3 by means of an external force such as plunger, etc. (not shown). The heat fusing resilient roller 2 is given its rotational force by its contact with the press-containing roller 3. On the other hand, the heating roller 4 is inhibited its rotation by a stopper 8 which has fallen into a groove 7 provided at one end part of the roller axle. As the result of this, when the heat fusing resilient roller 2 contacts the heating roller 4, it receives a wedging action by the press-contacting roller 3, and shifts between the rollers 3 and 4 with the elastic pressure being impressed thereon as shown in FIG. 4C.

Figures 4D, 4E, 4F:
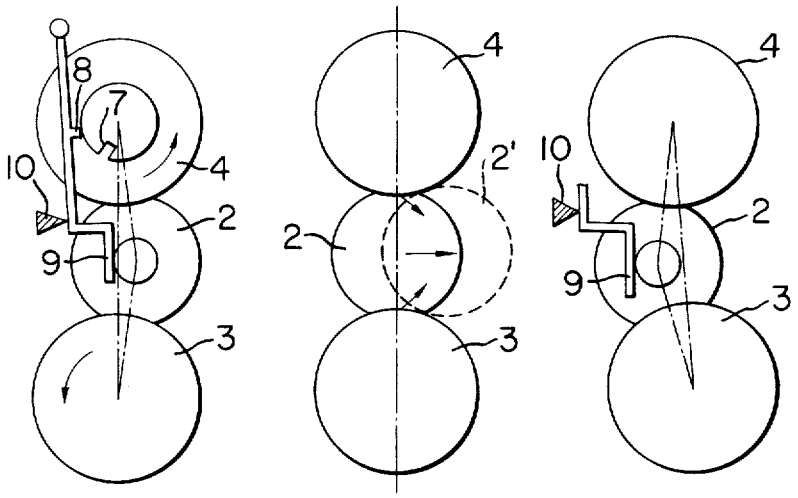

The heat fusing roller 2 causes the stopper 8 to separate from the groove 7 by urging an arm 9 of the stopper 8, in consequence of which the driving of the press-contacting roller 3 is transmitted from the heat fusing roller 2 to the heating roller 4. The stopper arm 9 when urged by the heat fusing roller 2 is stopped at a positioning stopper 10. When the press-contacting roller 3 ceases its driving, the heat fusing roller 2 is pulled back to the state as shown in FIG. 4A by the plunger (not shown). As shown in FIG. 4C, if the stopping position of the heat fusing roller 2 is forward the plane forward between the axes of the rollers 3 and 4 as shown in FIG. 4D, instead of pulling the heat fusing roller 2 back to its interposed position as shown in FIG. 4C, the heat fusing roller 2 is urged in the horizontal direction between the roller axes during its rotation by the press-contacting roller 3 in its driving operation. However, when the press-contacting roller 3 ceases its driving operation, the heat fusing roller 2 returns to its position 2' of elastic restitution by the elastic force of its own. Thus, the plunger for returning the heat fusing roller 2 to its position of restitution can be dispensed with. Otherwise, if the heat fusing roller 2 and the press-contacting roller 3 which is in driving operation are mutually in contact therewith as shown in FIG. 4B, not being in a separated condition as in FIG. 4A, the heat fusing roller 2 can be inserted between the rollers 3 and 4 as shown in FIG. 4C by the rotational force of the press-contacting roller 3 only without any external force whatsoever as by the plunger, when it is to be inserted therebetween. Incidentally, besides the positional relationship as in FIG. 4C and 4D, when the three rollers are positioned as in FIG. 4F, the heat fusing roller 2 is urged toward the stopper arm 9 with the result that the position of the roller becomes extremely advantageously stable.

As mentioned in the foregoing, the fixing device according to the present invention can be highly simplified in its driving system. On the other hand, as the heat fusing resilient roller does not have the heating device therewithin, thermal deterioration of the elastic substance constituting the roller becomes considerably reduced, hence the life of the roller is longer, its exchangeability is facilitated, and the manufacturing cost thereof can be remarkably reduced. Further, even if the diameter of the heat fusing roller is made small, the pressure to be applied thereon is maintained uniform in its distribution, since the pressure is applied by the heating roller 3 and the press-contacting roller 4 to produce the least flexure thereon. Also, as the heat fusing roller 2 is heated by only an external means, the elastic layer for the heat fusion can be made thicker on this heat fusing roller 2 with the consequence that the adiabatic effect of the roller can be increased so that the surface temperature rises within a short period of time.

Throughout this specification, the term "reproduction material" or "copying material" is used as has been done in the foregoing. It should be understood that the term includes all sorts of recording material for electrophotography, on which an image is to be reproduced, such as a transfer sheet in the conventional development-transfer system, an electrophotographic sensitive paper used in the conventional electrofax system, image transfer material in the conventional electrostatic image transfer and development system, and electrostatic recording paper which is subjected to development upon formation of an electrostatic latent image directly on any object such as bottles, tubes, etc., and any other like materials.

Figure 5:
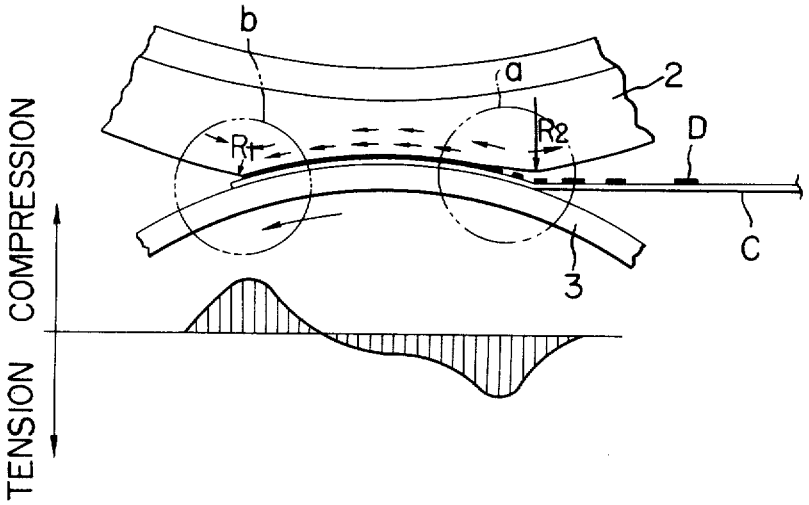
FIG. 5 is a fragmentary enlarged side elevational view of the device shown in FIG. 1.

FIG. 5 is a detailed fragmentary side elevational view showing the contact portion between the heat fusing roller 2 and the press-contacting roller 3 of the fixing device shown in FIG. 1. The structural details and operations of every part will now be explained hereinbelow.

The resilient roller 2 which is at the driven side of the roller assembly where deformation has occurred by the rigid press-contacting roller 3 creates an internal tensile stress at the encircled portion *a* with its contact surface being subjected to the leftward force due to its friction with the press-contacting roller 3 at the driving side at the elastic deforming portion thereof, and undergoes, inversely, the compression stress at the encircled portion *b*, whereby the elastic member constituting the heat fusing roller 2 concentrates on this encircled portion *b* owing to non-equilibrium of force, and the radius of curvature $1/R_1$ becomes inevitably very large. In consequence of this, the adhesive force between the developing agent and the elastic member of the roller 2 is defeated by the steadiness or tenacity of the reproduction material C to become readily separated with the result that the reproduction material C tends to move along the outer peripheral surface of the press-contacting roller 3.

While the peeling action can be expected from the deformed elastic roller, even if both rollers 2 and 3 are subjected to the driving action, it has been verified that a more remarkable effect can be achieved by bringing both these rollers into the driving and driven relationship as already mentioned above.

As the second advantage of this roller assembly, there can be pointed out the improvement in the cleaning capability by the topmost heating roller 4. As in the preceding explanation, it will be appreciated that, as the same phenomenon of the deformation as at the contact surface between the heat fusing resilient roller 2 and the lower rigid press-contacting roller 3 takes place at the contact surface between the heat fusing resilient roller 2 and the top heating roller 4, there always occurs slipping to some extent between these contacting rollers, even if the apparent number of revolutions of these two top and bottom rollers is same, when the single element surface in the press-contacted surface between the rollers is taken into consideration. At the same time, the level of the temperature in the roller assembly differs in the order of the heating roller 4 ≥ heat fusing roller 2 ≥ press-contacting roller 3. As seen, the temperature of the heating roller 4 is the highest, and the developing agent has a corresponding property which tends to be fused with this roller 4. On account of this, the roller 4 provides improved cleaning capability in conjunction with the slipping effect of the abovementioned element surface. In other words, since the developing agent adhered onto the rollers 2 and 3 as the contaminant is immediately collected at the surface of the roller 4, the surfaces of the roller 2 and 3 are assured to have satisfactory image fixing capability. It goes without saying that, in this case, the slipping effect of the single element surface should be within such extent that does not affect resolution, sharpness, etc. of the reproduced image.

The third advantage to be derived from the roller assembly according to the present invention is that smooth forwarding of the copying material is assured. In other words, since the intermediate heat fusing resilient roller 2 is in a smaller diameter than the diameters of the upper and lower rigid rollers 3 and 4, and is interposed therebetween in a press-contacted manner, the pressure in the axial direction of the roller 2 can distribute uniformly at the press-contacted surface, however small the diameter of the roller 2 may be made. Accordingly, even when a thin sheet material such as recording paper, etc. is caused to pass through the rollers 2 and 3, the pressing force would act uniformly thereon with the consequence that there is exhibited an effect such that no furrows, curvings, etc. may occur. Also, since the diameter of the roller 3 is larger than that of the roller 2, the paper itself is subjected to very little curling in spite of its being extended along the outer peripheral surface of the roller 3, so that such curling, if it occurs, can be restrained to an extent that does not bring about any practical trouble and inconvenience. There has usually been a tendency due to a desire to prevent paper or other thin sheet material from winding around the resilient roller, to make the diameter of the rigid press-contacting roller as small as possible. However, this increases the curling phenomenon so that the copy sheets cannot be placed in a uniformly flat manner when it is accumulated within a receptacle such as a receiving tray, and the like; rather, a serious disadvantage results in that the sheets are scattered in all directions making it difficult to neatly arrange them upon completion of the reproduction. However, by reducing the outer diameter of the intermediate resilient roller 2, the copying material is inhibited from wrapping around the roller, and there takes place no curling of the sheet. Accordingly, the sheets after their passage through the fixing device are received automatically and regularly into the tray or other kinds of receptables. This is a particularly important capability with automatic reproduction machinery which makes a multitude of copies.

As the fourth advantage of this roller assembly, there can be pointed out the effect of external heating. As has already been mentioned in the foregoing, heating of the resilient roller 2, which is inferior in its heat-conductivity, from outside by means of the roller 4 makes it possible to shorten the waiting time until the reproduction operation starts. Taken together with this shortened waiting time, it becomes also possible to precisely control the roller temperature, and a narrow range of temperature variation can be constantly established accordingly. That is to say, the resilient roller 2, only the outer peripheral surface of which has been heated, has its temperature decreased only at its surface part by contacting the sheet fed thereinto. And, in the next moment, upon passage of the sheet therethrough, the roller is again heated in the same manner. On account of repetition of such simple operation, very quick response to the temperature decrease becomes possible. Such effect can be derived from the fact that, since the heating is carried out from the surface side of the developing agent, the required amount of heat need be sufficient only to heat the developing agent and one side surface of the sheet to a certain temperature level, and that the amount of heat is also difficult to be affected by the thickness of the copying material, hygroscopicity of such copying material, and so on.

Figure 6:
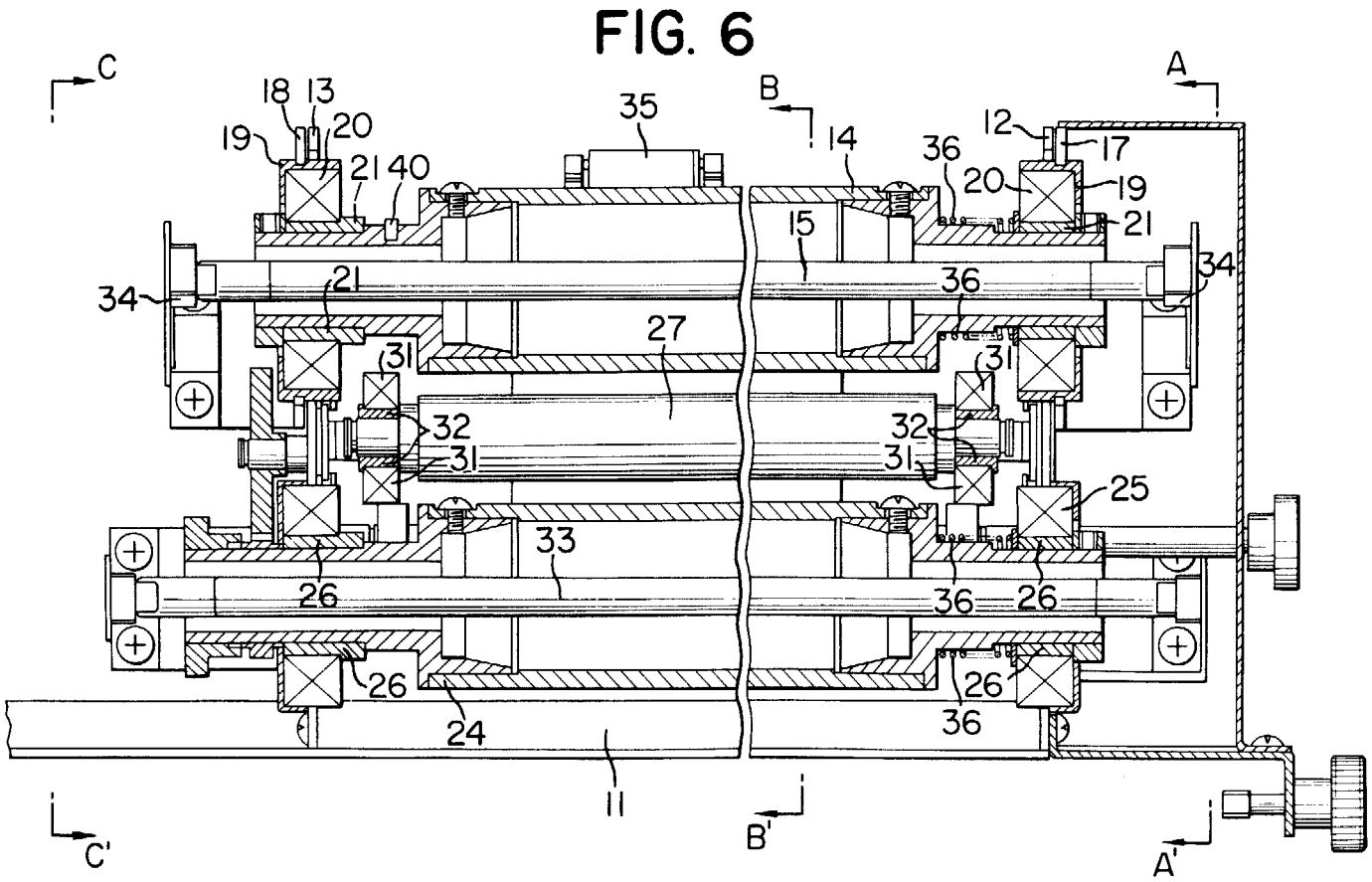
FIG. 6 is a longitudinal cross-section of the electrophotographic fixing device according to the present invention.
Figure 7:
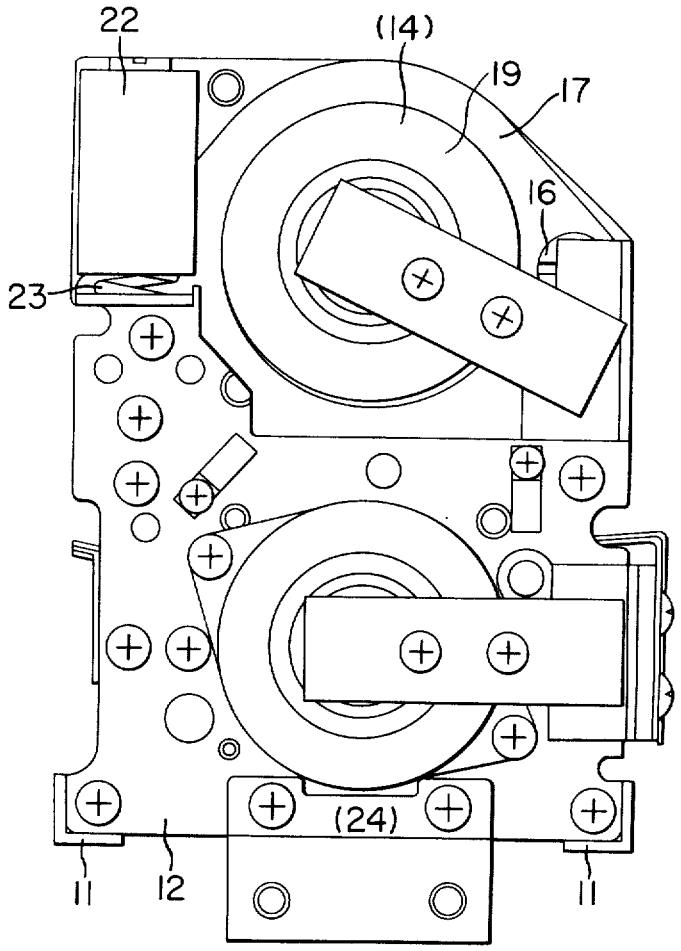
FIG. 7 is a cross-sectional view taken along the line A–A′ in FIG. 6 and viewed in the arrow direction.
Figure 8:
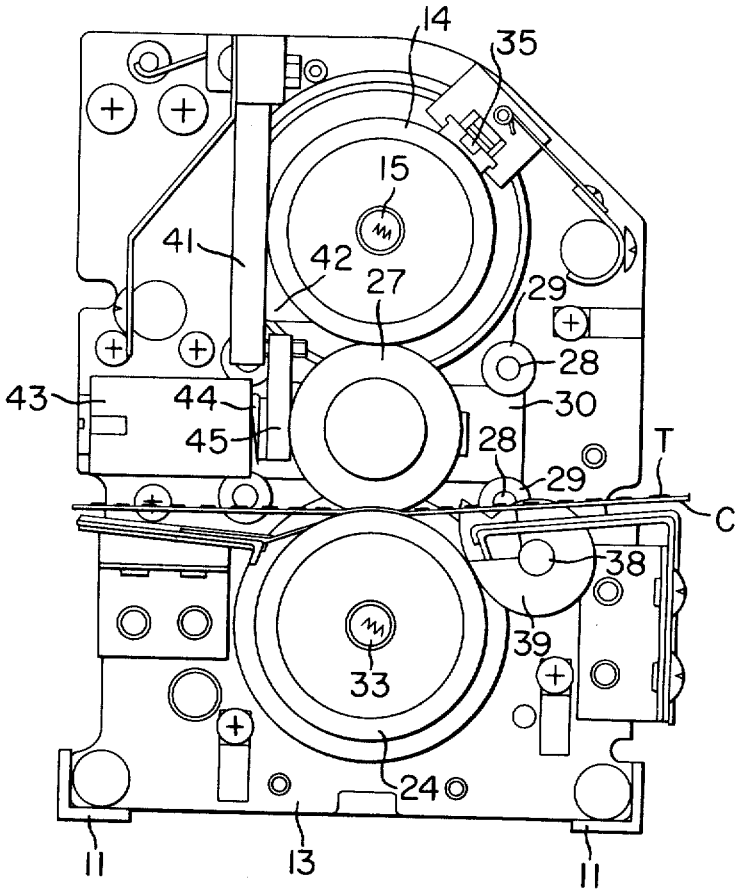
FIG. 8 is a cross-sectional view taken along the line B–B′ in FIG. 6 and viewed in the arrow direction.
Figure 9:
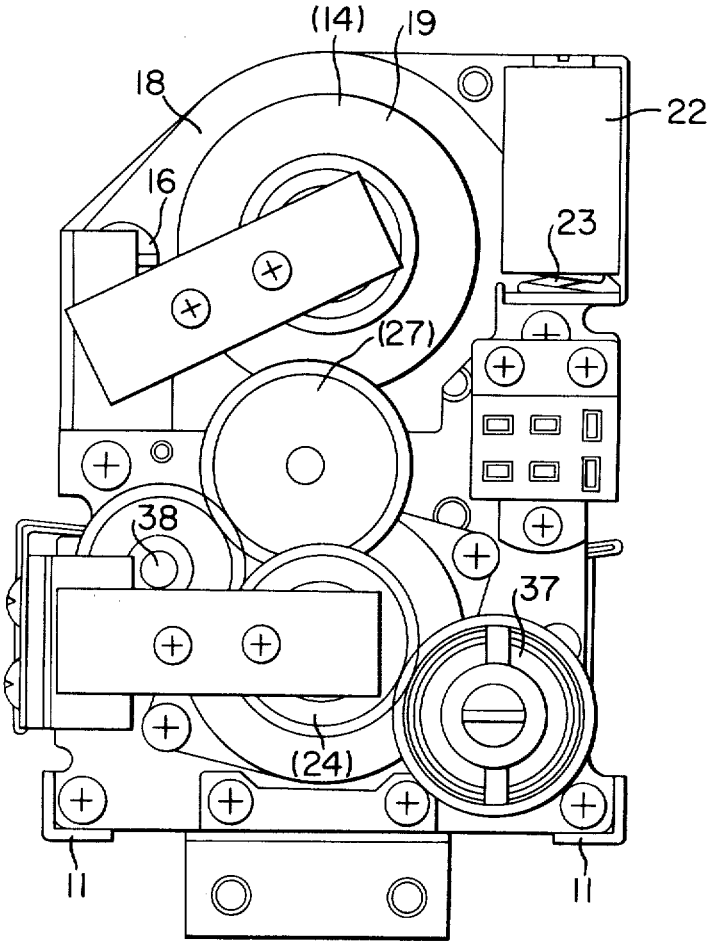
FIG. 9 is a cross-sectional view taken along the line C–C′ in FIG. 6 and viewed in the arrow direction.

FIG. 6 indicates a longitudinal cross-section of the electrophotographic fixing device according to the present invention. FIG. 7 is a cross-sectional view of this fixing device taken along the line A–A′ in FIG. 6, and viewed in the direction of the arrow. FIG. 8 is also a cross-sectional view of the same fixing device taken along the line B–B' in FIG. 6 and viewed in the same direction as in FIG. 7. FIG. 9 is another cross-sectional view of the device taken along the line C–C' and viewed in the feathered direction of the arrow mark. In the following, the fixing device will be explained in detail in reference to these figures of drawings.

The basic frame of the electrophotographic fixing device according to the present invention includes a first side plate 12 and a second side plate 13 fixedly secured on a rail 11 which is slidably fitted on a rail stand (not shown) for mounting the fixing device, which, in turn, is fixed on the main body of the electrophotographic reproduction apparatus.

The heating roller 14 is made of a metallic material of good heat conductivity such as aluminum, brass, and so on, and its hollow interior portion accommodates a heat source 15 of, for example an infrared ray resistance heating element, etc., and the inner wall surface thereof is coated with black paint, black plating, etc. to ameliorate the heat absorption capability. The wall thickness of the heating roller should be preferably as thin as possible within an extent that withstands any mechanical force both outside and inside so as to shorten the time period within which the surface temperature of the roller reaches a predetermined temperature level. In this case, however, temperature fluctuations tend to occur, not infrequently, at every point on the surface of the roller, and, in order to remove such temperature fluctuations, it is advisable to apply a thin coat of a heat resistant, adiabatic material such as, for example, Teflon, and so forth on the roller surface. If, in this coating operation, the thickness of the coating layer is made too thick, a longer time will inevitably be taken until the surface temperature of the heating roller arrives at its predetermined temperature.

The abovementioned first and second side plates respectively are further provided with movable plates 17 and 18 which are movable in the up and down direction on the fulcrum of a supporting bolt 16 fitted in each of these side plates, and the heating roller 14 is axially held in a freely rotatable manner by a bearing 20 in a bearing case 19 which adjoins each of the movable plates 17 and 18. At this time, in order to prevent the bearing 20 from fatigue due to heat from the heating roller 4, it is recommended to interpose a heat-resistant, adiabatic bush 21 such as, for example, phenol resin, etc. between the bearing 20 and heating roller 14. The abovementioned movable plates 17 and 18 are imparted with a downward pressure (as viewed in the drawing) by a compression spring 23 accomodated in a spring box 22 which is fixed at the side plate 13, and urged downward with the supporting bolt 16 as the fulcrum.

The material for the rigid roller 24 may be selected from metals of high heat-conductivity such as aluminum, brass, and so forth. The surface of this rigid roller is covered with a layer of a material such as, for example, Teflon, on which the heat fusible developed image resists being offset. The reason for applying the offset prevention material on the surface of this rigid roller 24 is so that, not only the heat fusible toner which has been partially adhered onto the roller in the case of one-side copying may be effectively and completely removed therefrom, but also, in particular, to prevent the offsetting of the toner which has become softened again at the time of a second passage of the copying material through the fixing roller during both-side copying, during which the surface of the copy sheet having an image already fixed thereon contacts the rigid roller 24. The rigid roller 24 is axially supported in a freely rotatable manner by the bearing 25 fitted on the aforementioned first and second side plates 12 and 13. Since the rigid roller 24 is also subjected to a considerable amount of heat from the heat fusing roller 14, it is again recommended to interpose a heat-resistant, adiabatic bush 26 such as, for example, phenol resin, etc. of the same nature as that of the bush 21 for the bearing 20, between the rigid roller 24 and the bearing 25 so as to prevent possible fatigue of the bearing.

Since the heat fusing roller 27 performs the fixing action by directly contacting the developed image on the copying material, it is coated with a layer of a material such as silicone rubber, etc. which has good separability with respect to the copying material and the developed image so as to prevent the image from being offset on the roller surface. Spanning across the first side plate 12 and the second side plate 13, a shaft 28 is fixedly supported, on which a slide plate 30 is slidably provided by way of a roller 29. The slide plate 30 is provided thereon with a bearing 31, and the heat fusing roller 27 is rotatably supported by this bearing 31 without being subjected to any hindering resistance. By this construction, the heat fusing roller 27 can be disposed between the operating position, where it receives elastic deformation by being press-contacted between the rigid roller 24 and the heating roller 14, and the releasing positions, where it is away from these two rollers. In this roller assembly, as the heat fusing roller 27 also receives a large amount of heat from the heating roller, it is necessary to interpose the heat-resistant, adiabatic bush 32 between the bearing 31 and the heat fusing roller 27. The copying material C having thereon a toner image T is conveyed between this heat fusing roller 27 and the rigid roller 24 under a high squeezing force, and subjected to heat fusion, while passing through the rollers, whereby the image on the copying material is fixed firmly.

Since the heating roller 14 is urged downwardly by the compression spring 23, when the heat fusing roller 27 is inserted between the rigid roller 24 and the heating roller 14, this heat fusing roller 27 brings about the elastic deformation by a high pressure applied thereon. Another way, in which the pressure is to be applied to this heat fusing roller, may be such that the heating roller 14 is axially supported in a freely rotatable manner at a fixed position on the first side plate 12 and the second side plate 13 where it is subjected to the elastic deformation necessary for insertion between the two rollers, whereby a high pressure is obtained without the compression spring 23. The effect to be realized at this time is that, irrespective of fluctuations in the hardness of the rubber constituting the heat fusing roller 27, the quantity of the rubber deformation becomes constant, and the contact time of the copying material with the heat fusing roller for the required image fixing can be advantageously maintained constant. Supply of heat of the heat fusing roller 27 is usually done by the heat source 15 within the heating roller 14, and it is, of course, possible to provide an auxiliary heat source 33 within the rigid roller 24. The resistance heating element as the heat source 15 is connected to a power source by way of a contact 34 which is in a fixed position so as not to come into contact with the inner surface of the rigid roller 24. A thermistor 35 for the purpose of controlling electric power to be supplied to this resistance heating element is arranged in direct contact with or in proximity to the surface of the heating roller 14 so as to maintain a satisfactory thermal relationship. For the purpose of adjusting expansion and contraction of the heating roller 14 and the rigid roller 24 in their longitudinal direction, due to temperature variations a sufficient clearance or gap is provided between the end part of the rollers and the side plate opposite thereto, and a compression spring 36 is provided to absorb any lateral shaking.

Explaining now the driving mechanism of the electrophotographic fixing device according to the present invention, the driving source for the overall fixing device is a gear assembly 37 connected to a power source (not shown) when the electrophotographic reproduction apparatus is in an ordinary operation condition. This gear assembly 37 is arranged in such a manner that, when the reproduction material is being conveyed to the fixing device, the rigid roller 24 may forward this reproduction material at a speed equal to the linear speed of this reproduction material. At this time, a cam 39 fitted on a rotational shaft 38 is rotated at a comparatively slow speed with respect to the rigid roller 24.

Next, explanations will be given as to the fixing operation and the non-fixing operation of the fixing device according to the present invention in the course of operations of the electrophotographic reproduction apparatus. The characteristic feature of the fixing device according to the present invention is that the heat fusing roller 27 can take the releasing position where it is not subjected to the elastic deformation, and the operating position where it receives the elastic deformation between the heating roller and the rigid roller. The physical construction and functions of such fixing device will now be described in detail in the following in reference to FIGS. 10A through 10F.

Figure 10A:
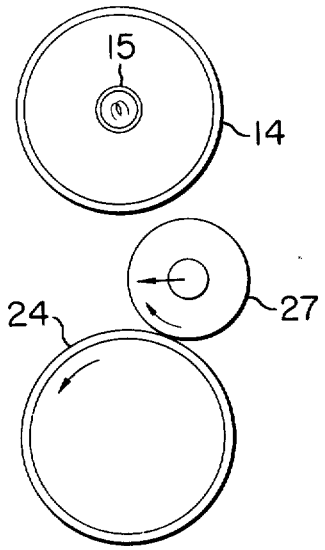
FIGS. 10A through 10F are respectively operational diagrams of the device according to the present invention.
Figure 10B:
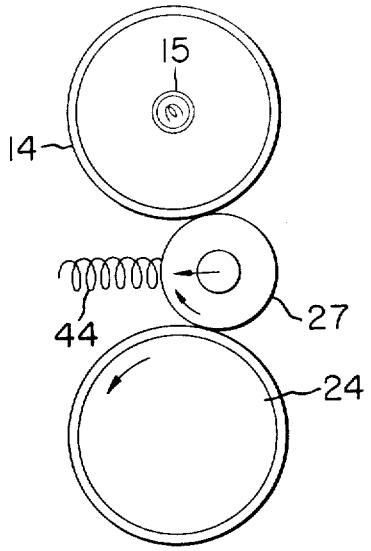
Figure 10C:
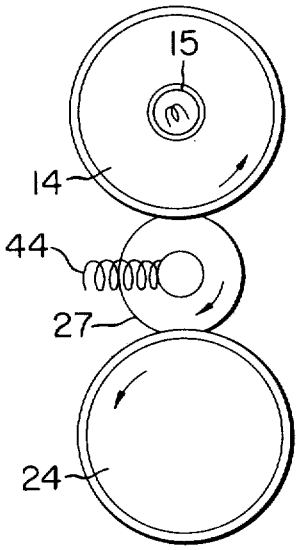

When the fixing device commences its driving action, the cam 39 begins to rotate, along with which the heat fusing roller 27 proceeds, while rotating, to a position at which it contacts the heating roller 14 as shown in FIG. 10B from its releasing position as shown in FIG. 10A, by means of this cam 39 or by other external forces.

Figure 10D:
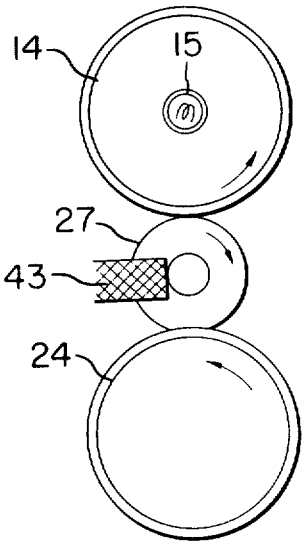
Figure 10E:
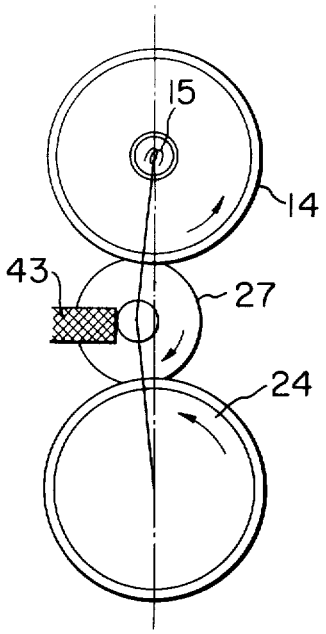
Figure 10F:
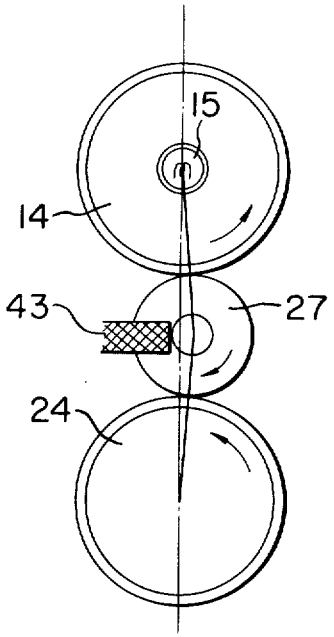

However, the heating roller 14, at this time, is kept from rotating by the action of a block 42 fitted on a pin 40 and an arm 41 on the heating roller as illustrated, or by the action of a stopper such as a rathet wheel, etc. (not shown). Accordingly, the heat fusing roller 27 by its wedging action goes in to contact the heating roller 14 together with the sliding plate 30, while rotating with the surface of the heating roller 14 as the center of rotation. In the course of this roller proceeding, the sliding plate 30 charges the compression spring 44 within the spring block 43 which is disposed in the direction opposite to the proceeding of the heat fusing roller 27. When the heat fusing roller 27 comes to a point in the vicinity of the center line of the heating roller 14 and the rigid roller 24, the block 45 fixed on the sliding plate 30 pushes the arm 41 to release the stoppers 40 and 42, which commence rotation. At this time, the position of the heat fusing roller 27 can be adjusted in three ways as shown in FIGS. 10A through 10F by the positional adjustments of the blocks 43, etc., with which the sliding plate 30 contacts. That is, as the position of the heat fusing roller 27 is within one and the same plane as the heating roller 14 and the rigid roller 24 as indicated in FIG. 10D, its position is such that the center thereof is in front of the center line of the two rollers 14 and 24 as indicated in FIG. 10E when viewed from the left side of the drawing, and its position is such that the center thereof is to the rear of the center line of the two rollers 14 and 24 as indicated in FIG. 10F.

The advantage of the position shown in FIG. 10E is such that, as the heat fusing roller 27 is urged toward the block 43 due to the elastic force, its position becomes highly stable. Upon completion of the driving, the heat fusing roller 27 is pushed back to its releasing position as shown in FIG. 10A by an external force such as the spring 44 already charged in the afore-mentioned manner. In this case, as the rotation of the rigid roller 24 is dull, any lubricating layer such as Teflon, and so on may be coated on the heating roller 14 as mentioned in the foregoing to facilitate return of the heat fusing roller 27 to the releasing position. The advantage of the position shown in FIG. 10F is such that, when the rigid roller 24 stops, the heat fusing roller 27 goes back to its releasing position as shown in FIG. 10A by its own elastic restitution without any assistance from an external force such as by the spring 44, etc.

As has been stated in the foregoing, the driving system for the fixing device according to the present invention is quite simple in its construction. On the other hand, as the resilient heat fusing roller is not provided with heating means within itself, the thermal deterioration of the constituent substance is kept to a minimum to render it reliable over a long period. Moreover, it can be exchanged very simply, and the manufacturing cost thereof is low. Further, as the pressure to the copying material is applied by the rollers 14 and 24, flexure of the heat fusing roller 27 is small, even if its diameter is made small, whereby the pressure applied on the heat fusing roller 27 becomes uniform. Also, since the heating of the heat fusing roller 27 is done by the external heating means along, the layer of the elastic material for the heat fusion can be made thick, which enables the adiabatic effect to increase, and the surface temperature of the roller to rise in a short period of time.

Figure 11:
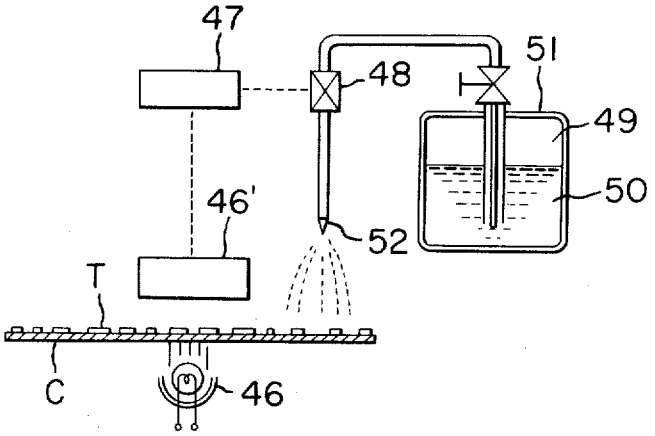
FIG. 11 is a schematic side elevational view showing a construction of a device for applying an image removing agent according to the present invention.

FIG. 11 is a schematic diagram showing one embodiment of a device for facilitating copying material having a non-fixed reproduction image thereon, which device is provided at the processing position preceding the position of the heat roller type fixing device. That is, when the non-fixed reproduction images T on the copying material C are detected by a detecting means consisting a light projecting element 46 and a light receiving element 46' provided in the process position preceding that of the heat roller type fixing device as shown in FIGS. 1 and 8, an electromagnetic valve 48 is actuated by a circuit 47 such as, for example, a timer circuit, whereby an image removing agent 50 is ejected through a nozzle 52 for a certain period of time from a reservoir 51 storing therein compressed air 49 and the image separating agent 50, whereby only the front end part of the non-fixed reproduction image is covered at a certain width with this image separating agent. The image separating agent may be selected from any type of feasible substances such as poppy oil image removing and coating agent, powdery image removing agent like silicon oxide, and silicone oil image removing agent.

By this non-fixed image separating device, if becomes possible for the image separating agent 50 to be formed into a liquid or powder coating which can be applied on the front end part of the image surface of the non-fixed image holding material C with a certain width. The non-fixed image holding material with its front end part having been treated with a certain width is then fixed by the heat roller type fixing device, and, simultaneously, its front tip end part is peeled off the roller without the image holding or copying material being wrapped around the roller. The thus exfoliated front tip end part is then forwarded to the paper discharging roller by the guide 5 (FIG. 1), whereby the entire image surface is withdrawn from the fixing device and discharged outside without wrapping around the fixing roller 2 (FIG. 1).

According to experiments conducted by the present inventors, by the application of the silicone image separating agent on the front end part of the reproduced image in entirely solid black with an area corresponding to about one tenth of the total area of the entire image surface, there could be realized satisfactory separation of the non-fixed image without offsetting of the image onto the heating roller, and a fixed image of good quality could be obtained. At this time, it has also been verified that no hand touch or smell of the image separation agent can be detected, nor was any running of ink visible.

From the experiments, it has also been found that, by using the image removing agent of the same type as the material coated on the heating roller, the surface activity of the coated material on the heating roller can be maintained constant.

Furthermore, even in the pressure type fixing device, by applying silicone powder on the front end of the image surface with a certain width prior to effecting the fixing step, the separation becomes satisfactory without use of any mechanical separation device such as separating pawls, etc., whereby the offsetting of the image onto the roller can be prevented.

As mentioned in the foregoing, the present invention also provides a non-fixed image separating device for facilitating separation of the reproduced image from the roller type fixing device, and preventing the image from offsetting on the roller surface, wherein the minimum required quantity of the image separating agent is applied to the front end part of the non-fixed reproduction object with a certain width in the process step preceding the roller type fixing device. According to the device of this invention, the quantity of the image separating agent to be used can be made extremely small. Also, any kind of image separating agent can be used without substantial restriction, hence not only the image separating agent which brings about thermal deterioration after being heated for a long period of time, but also powder image separation agent and a coating former may be used, so that it serves to prevent the atmosphere from contamination and is highly economical.

Also, as the image separating agent need be applied only on the front tip end part of the non-fixed image with a certain width, there is no apprehension of the fixed image surface repelling ink, which has been one of the defects in the conventional device, wherein the image separating agent is directly applied on the surface of the fixing roller.

Figure 12:
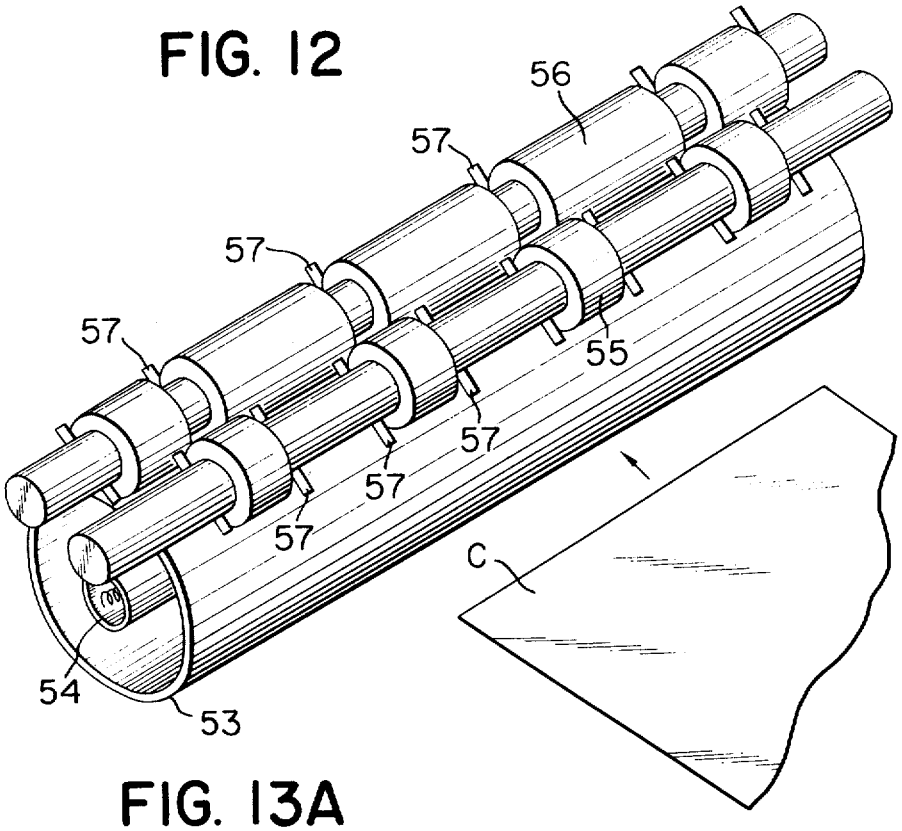
FIGS. 12 through 19 are respectively preferred embodiments of the electrophotographic fixing device according to the present invention.

FIG. 12 shows a case, wherein discontinuous and intermittent rollers are used as the pressing roller to convey the copying material to the heat fusing roller. For the reproduction material to be prevented from winding around this discontinuous pressing roller, a guide member for the separation is provided so as to carry out the separating action of the reproduction material in a perfect manner.

In the drawing, the rigid heat fusing roller 53 is provided in the hollow interior thereof with the heat source 54. At a position contiguous to the rigid heat fusing roller 53, there are provided press-contacting rollers 55 and 56 to carry forward under pressure the reproduction material C bearing thereon a developed image T. These press-contacting rollers are constructed with discontinuous and intermittent rollers. The reproduction material, which has been subjected to heat fusion, tends to wind around the press-contacting rollers 55 and 56, although this tendency is prevented by the separation guide member 57 provided at the discontinuous portions of the press-contacting rollers, whereby the reproduction material can be separated and discharged outside without winding around the rollers.

These discontinuous press-contacting rollers are constructed with an elastic material such as silicone, etc. which makes it difficult to cause the image to offset on the roller, and these rollers 55 and 56 are arranged in a staggered form so that the discontinuous portion in each press-contacting roller may be compensated by the roller portions of the counterpart roller. Preferably the discontinuous portions of one roller should be mutually overlapped by the roller portion of the counterpart roller. It should be appreciated that no effect upon the reproduced image results from the reproduction material being press-contacted overlappingly to the heat fusing roller.

As to the setting position of the separation guide member 57, if the gap between this separation guide member and the heat fusing roller is close each other, the reproduction material can be forcibly separated immediately by this separating guide member, even when the reproduction material tends to wind around the press-contacting roller. On the other hand, however, if the gap between this separation guide member and the heat fusing roller is large, the wrapping force of the reproduction material around the press-contacting roller rapidly increases to lower its separability, because the contact time of the reproduction material to the press-contacting roller becomes longer with such wide gap between the separation guide member and the heat fusing roller. In the case of the discontinuous and intermittent press-contacting roller, the separation effect will be better, if the breadth of the roller portions in this discontinuous and intermittent press-contacting roller is as narrow as possible, because reduction in the contact area between the press-contacting roller and the developed image reflects upon decrease in the wrapping force of the reproduction material around the heat fusing roller.

Figure 13A:
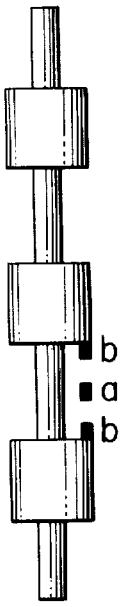
Figure 13B:
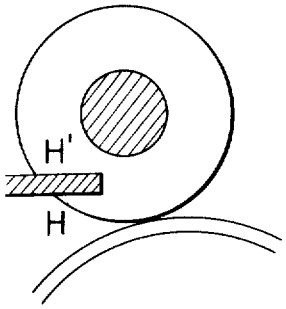

As to the fitting position of the separation guide member 57 at the discontinuous portions in the discontinuous and intermittent press-contacting roller, it is preferable that the separation guide member be provided at as close a position as possible to the end parts of the roller portions for the required separability, as shown in FIGS. 13A annd 13B. Such positions are indicated in FIG. 13A with a reference symbol *b*. This separability, on the contrary, lowers when the fitting position of the separation guide member becomes spaced from the end parts of the roller portions as indicated by the reference symbol *a* in FIG. 13A. The reason for this is that, when the separation guide member is close to the roller, the image holding member, or the reproduction material is separated from the roller at the effective position H of the separation guide member as shown in FIG. 13B, but, if the separation guide member is spaced from the end parts of the roller portions, the position, at which the image holding member separates from the roller, shifts to H' which is behind the position H. Therefore, the abovementioned prolonged contact time, or strength of the reproduction sheet, and other factors are considered to affect the separability of the reproduction sheet from the heat fusing roller.

In the following, the fixing device according to the present invention will be explained in detail with reference to preferred embodiments as shown in FIGS. 14 through 19.

Figure 14:
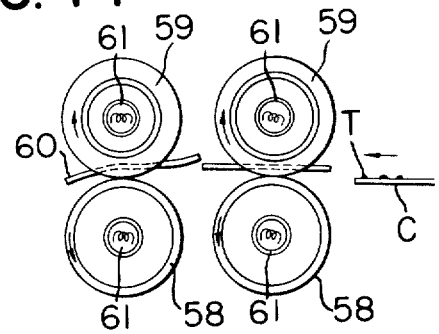
Figure 15:
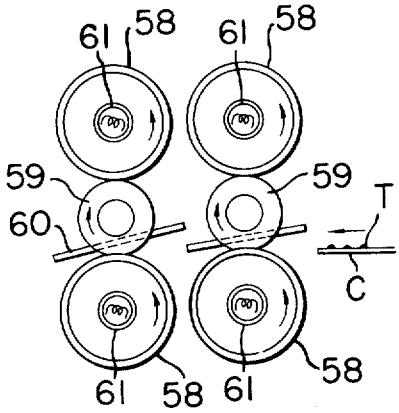

Referring to FIGS. 14 and 15, th fundamental construction of the fixing device comprises a rigid roller 58, an elastic roller 59 made of silicone, and like materials a separation guide member 60, and a heat source 61. The reference letters C and T in the figures designate, respectively, a reproduction or copying material and a developed image on this copying material C. The elastic roller 59 is rotatably press-contacted against the rigid roller 58.

FIGS. 14 and 15 indicate that a plurality of unit fixing devices are arranged in tiers (two rows in the illustrated embodiment). Of course, the elastic roller 59 are in a discontinuous and intermittent construction and arranged in a staggered form to compensate for the discontinuous portions with the roller portions of the counterpart, whereby the entire image surface is fixed by these intermittent rollers in an overlapping manner.

Figure 16:
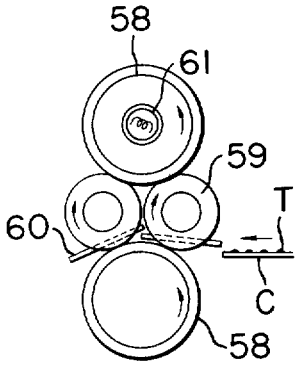
Figure 18:
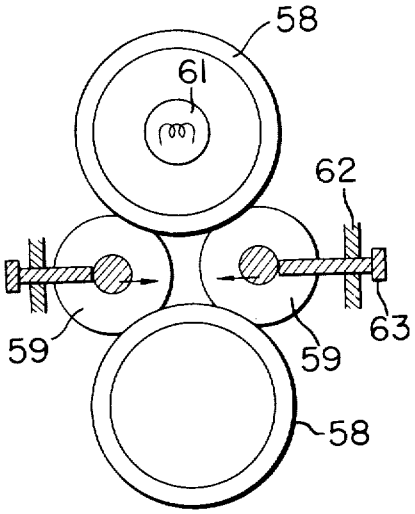
Figure 19:
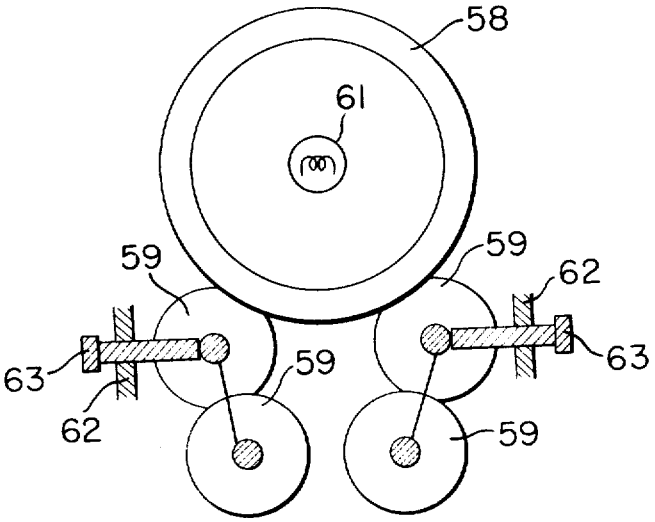

In the embodiment shown in FIG. 16, two elastic rollers 59 are pushed in between the upper rigid roller 58 and the lower rigid roller 58 and fixed in the state of their being spaced from each other at their peripheral surfaces. The advantage to be derived from this construction is such that, as shown in FIG. 18, the silicone roller 59 can be made easily rotatable under a press-contacted state against the rigid roller 58 in utilization of the elasticity of the silicone rubber roller 59 per se, by means of threaded screw bolts which are screwed toward the roller 59 through fixed walls 62 on both sides. Although not shown, the pressure application to the elastic silicone rubber roller 59 can be readily released in an opposite manner by screwing out the threaded screw bolts. Thus, by separating the elastic rollers from the heat fusing rollers at the time of non-operation, deterioration due to heat of the silicone rubber rollers and deformation due to pressure of such rubber rollers can be very effectively prevented. Also, this construction is advantageous in its thermal efficiency in comparison with the constructions shown in FIGS. 14 and 15. Furthermore, while the roller constructions shown in FIGS. 14 and 15 should unavoidably distribute the heat source in each of the plurality of rollers within the limited wattage appropriated to the fixing device, the roller construction shown in FIG. 16 effectively concentrates such heat source in a single roller, and yet uniform heat distribution can be effected to all of the plurality of the silicone rubber rollers 59.

Figure 17:
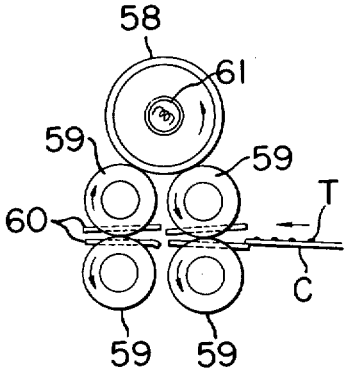

In still another embodiment shown in FIG. 17, another pair of elastic rubber rollers 59 are provided beneath the first pair of the elastic rubber rollers 59 as in FIGS. 16 and 18 in contiguity thereto. An advantage to be derived from this type of the roller construction is that the separation guide member can also be fitted readily even on this lower pair of the elastic rubber rollers 59. This duplicate pair construction is particularly effective in preventing the reproduction material from wrapping around the heat fusing rollers during two-side copying, wherein powder images are formed on both surfaces of the reproduction material. It goes without saying that, at this time, as the reproduction material passes through the rollers in a contact state, with the fixed image surface being faced to the side of the rigid roller, more stability will be attained when the rigid roller is coated on its peripheral surface with a coating layer of Teflon, silicone, and so on, which is incompatible with the toner.

While the present invention has been illustrated and described by way of preferred embodiments thereof, it is to be understood that such are merely illustrative and not restrictive, and that variations and modifications may be made therein without departing from the spirit and scope of the present invention as set forth in the appended claims.

We claim:

1. An electrophotographic fixing device which comprises in combination: a first heat fusing roller of elastic heat-insulating material provided at a position to contact a developed image on a reproduction material; a second roller having a press-contacting surface provided at a position to urge said reproduction material against said heat fusing roller, wherein said press-contacting roller deforms the surface of said heat fusing roller; and a heating roller provided at a position to heat the peripheral surface of said heat fusing roller, wherein said heating roller and said press-contacting roller are spaced apart at a distance wheich is less than the diameter of said heat fusing roller, and said heat fusing roller is mounted for radial movement between a first position away from both said heating roller and said press-contacting roller, and a second position wherein it is interposed between said heating roller and said press-contacting roller.

2. An electrophotographic fixing device according to claim 1, wherein said heating roller is hollow, thereby providing an inner wall surface; wherein said inner wall surface of said heating roller is painted black at both end parts thereof in the axial direction; and wherein said heating roller has a heat source disposed within the hollow interior thereof.

3. An electrophotographic fixing device which comprises in combination: a heat fusing roller of elastic heat-insulating material provided at a position to contact a developed image on a reproduction material; a press-contacting roller provided at a position to urge said reproduction material against said heat fusing roller, wherein said press-contacting roller deforms the surface of said heat fusing roller; and a heating roller provided at a position to heat the peripheral surface of said heat fusing roller, wherein said heating roller is provided with a set temperature and includes means for increasing said set temperature at the time of contact with the reproduction material.

4. The electrophotographic fixing device according to claim 1, wherein the surface temperature of each of said rollers is given a gradient in the sequence of the heating roller $\geqq$ heat fusing roller $\geqq$ the press-contacting roller.

5. An electrophotographic fixing device according to claim 2, further comprising: a driving means to drive one of said heating roller and said press-contacting roller; stopper means for stopping the other one of said press-contacting roller and said heating roller; and means to release said stopper means when said heat fusing roller is disposed at said second position.

6. An electrophotographic fixing device according to claim 1, wherein said heat fusing roller, in both said first and second positions, is situated to the same side of a plane passing through the axes of both said heating roller and said press-contacting roller.

7. An electrophotographic fixing device according to claim 1, wherein said heat fusing roller, when in said first and second positions, is situated respectively at opposite sides of a plane passing through the axes of both said heating roller and said press-contacting roller.

8. The electrophotographic fixing device according to claim 5, further including a spring means to cause said heat fusing roller to return to the first position from the second position thereof, said spring means being charged at the time of said heat fusing roller shifting from its first position to its second position so as to return said heat fusing roller to its first position by the charged spring force when the roller at the driving side ceases rotation.

9. An electrophotographic fixing device which comprises in combination: a heat fusing roller of elastic heat-insulating material provided at a position to contact a developed image on a reproduction material; a press-contacting roller provided at a position to urge said reproduction material against said heat fusing roller, wherein said press-contacting roller deforms the surface of said heat fusing roller; and a heating roller provided at a position to heat the peripheral surface of said heat fusing roller, wherein said heat fusing roller is constructed with a discontinuous surface and has a separation guide member provided at each of the discontinuous portions thereof.

10. An electrophotgraphic fixing device according to claim 9, wherein a plurality of said first rollers, each having a discontinuous surface, are disposed in a staggered relationship so that each of the discontinuous portions is compensated by the roller portion of another of said plurality of first rollers.

11. An electrophotographic fixing device which comprises in combination: a heat fusing roller of elastic heat-insulating material provided at a position to contact a developed image on a reproduction material; a press-contacting roller provided at a position to urge said reproduction material against said heat fusing roller, wherein said press-contacting roller deforms the surface of said heat fusing roller; and a heating roller provided at a position to heat the peripheral surface of said heat fusing roller, and further including means to detect a non-fixed reproduced object on the reproduction material; means for applying an image separating agent to said material; and a timer to actuate said image separating agent applying means for a predetermined time interval in response to the detection of a non-fixed object by said detecting means, wherein said predetermined time interval is chosen so that the application of said image separating agent is effected only at the leading end part of said material.

12. An electrophotographic fixing device according to claim 11, further including means for withdrawing said leading end part of said reproduction material from said heat fusing foller and for preventing the remainder of said material from wrapping around the roller so that said material is discharged from said device

13. an electrophotographic fixing device which comprises in combination: a heat fusing roller of elastic heat-insulating material provided at a position to contact a developed image on a reproduction material; a press-contacting roller provided at a position to urge said reproduction material against said heat fusing roller, wherein said press-contacting roller deforms the surface of said heat fusing roller; and a heating roller provided at a position to heat the peripheral surface of said heat fusing roller, wherein the diameter of said heat fusing roller is made smaller than the diameter of said heating roller.

14. An electrophotographic fixing device which comprises in combination: a heat fusing roller of elastic heat-insulating material provided at a position to contact a developed image on a reproduction material; a press-contacting roller provided at a position to urge said reproduction material against said heat fusing roller, wherein the diameter of the elastic heat fusing roller is made larger than the diameter of the press-contacting roller, and wherein said press-contacting roller deforms the surface of said heat fusing roller; and a heating roller provided at a position to heat the peripheral surface of said heat fusing roller, wherein the diameter of said heat fusing roller is made smaller than the diameter of said press-contacting roller.

* * * * *

UNITED STATES PATENT OFFICE

CERTIFICATE OF CORRECTION

Patent No. 3,945,726 Dated March 23, 1976

Inventor(s) YOSHIO ITO, TORU TAKAHASHI, TAKAYUKI ISHIHARA, HIROO KOBAYASHI, ATSUSHI MATSUOKA It is certified that error appears in the above-identified patent and that said Letters Patent are hereby corrected as shown below:

Column 4, line 35, delete "heatinsulating" and insert --heat insulating--;

Column 6, line 13, after "forward" insert --of--;

Column 12, line 43, after "facilitating" insert --separation of--;

Column 15, line 16, delete "th" and insert --the--;

Claim 1, line 32, delete "wheich" and insert --which--;

Claim 5, line 65, delete "2" and insert --1--;

Claim 12, line 17, delete "foller" and insert --roller--;

" line 20, after "vice" insert --.--;

Claim 13, line 21, change "an" to --An--.

Signed and Sealed this fifteenth Day of June 1976

[SEAL]

Attest:

RUTH C. MASON
Attesting Officer

C. MARSHALL DANN
Commissioner of Patents and Trademarks